US006337915B1

(12) United States Patent
Lewis

(10) Patent No.: US 6,337,915 B1
(45) Date of Patent: Jan. 8, 2002

(54) EARPHONE

(76) Inventor: Michael Lewis, 12 Semillon Grove, Mt. Clear, Victoria 3350 (AU)

( * ) Notice: Subject to any disclaimer, the term of this patent is extended or adjusted under 35 U.S.C. 154(b) by 0 days.

(21) Appl. No.: 09/544,432

(22) Filed: Apr. 7, 2000

(51) Int. Cl.[7] ..... H04R 25/00
(52) U.S. Cl. ..... 381/380; 381/328; 381/309
(58) Field of Search ..... 381/309, 326, 381/328, 370, 380, FOR 126, FOR 149, FOR 151; 379/430; 181/129, 130, 135

(56) References Cited

U.S. PATENT DOCUMENTS

| | | | | |
|---|---|---|---|---|
| 3,068,954 A | * | 12/1962 | Strzalkowski | 381/326 |
| 3,688,052 A | | 8/1972 | Self et al. | |
| 3,826,987 A | | 7/1974 | Stevens | |
| 4,375,016 A | * | 2/1983 | Harada | 181/135 |
| 4,584,718 A | | 4/1986 | Fuller | |
| 4,683,587 A | | 7/1987 | Silverman | |
| 4,742,887 A | * | 5/1988 | Yamagishi | 181/129 |
| 4,862,509 A | | 8/1989 | Towsend | |
| 5,048,092 A | * | 9/1991 | Yamaghishi et al. | 381/380 |
| D378,127 S | | 2/1997 | Brown | |

FOREIGN PATENT DOCUMENTS

| | | | | |
|---|---|---|---|---|
| GB | 2197158 | * | 5/1988 | 381/173 |

* cited by examiner

*Primary Examiner*—Huyen Le

(57) ABSTRACT

A earphone for comfortably fitting into the ear to listen to a personal stereo. The earphone includes a housing adapted for inserting in to an ear of a person. A speaker is adapted for reproducing sound generated by a personal stereo. The speaker is operationally coupled to the personal stereo. The speaker is mounted within the housing. A plurality of bores through the housing are adapted for equalizing air pressure between the atmosphere and the ear of the user.

19 Claims, 3 Drawing Sheets

2
1
1

23
22
12
10
3
14
28
20
28
3

28
12
23
32
22
28
30

22
30
23

EARPHONE

BACKGROUND OF THE INVENTION

1. Field of the Invention

The present invention relates to sound producing earplugs and more particularly pertains to a new earphone for comfortably fitting into the ear to listen to a personal stereo.

2. Description of the Prior Art

The use of sound producing earplugs is known in the prior art. More specifically, sound producing earplugs heretofore devised and utilized are known to consist basically of familiar, expected and obvious structural configurations, notwithstanding the myriad of designs encompassed by the crowded prior art which have been developed for the fulfillment of countless objectives and requirements.

Known prior art includes U.S. Pat. Nos. 4,862,509; 4,683,587; 4,584,718; 3,826,987; 3,688,052; and U.S. Pat. No. Des. 378,127.

While these devices fulfill their respective, particular objectives and requirements, the aforementioned patents do not disclose a new earphone. The inventive device includes a housing adapted for inserting in to an ear of a person. A speaker is adapted for reproducing sound generated by a personal stereo. The speaker is operationally coupled to the personal stereo. The speaker is mounted within the housing. A plurality of bores through the housing are adapted for equalizing air pressure between the atmosphere and the ear of the user.

In these respects, the earphone according to the present invention substantially departs from the conventional concepts and designs of the prior art, and in so doing provides an apparatus primarily developed for the purpose of comfortably fitting into the ear to listen to a personal stereo.

SUMMARY OF THE INVENTION

In view of the foregoing disadvantages inherent in the known types of sound producing earplugs now present in the prior art, the present invention provides a new earphone construction wherein the same can be utilized for comfortably fitting into the ear to listen to a personal stereo.

The general purpose of the present invention, which will be described subsequently in greater detail, is to provide a new earphone apparatus and method which has many of the advantages of the sound producing earplugs mentioned heretofore and many novel features that result in a new earphone which is not anticipated, rendered obvious, suggested, or even implied by any of the prior art sound producing earplugs, either alone or in any combination thereof.

To attain this, the present invention generally comprises a housing adapted for inserting in to an ear of a person. A speaker is adapted for reproducing sound generated by a personal stereo. The speaker is operationally coupled to the personal stereo. The speaker is mounted within the housing. A plurality of bores through the housing are adapted for equalizing air pressure between the atmosphere and the ear of the user.

There has thus been outlined, rather broadly, the more important features of the invention in order that the detailed description thereof that follows may be better understood, and in order that the present contribution to the art may be better appreciated. There are additional features of the invention that will be described hereinafter and which will form the subject matter of the claims appended hereto.

In this respect, before explaining at least one embodiment of the invention in detail, it is to be understood that the invention is not limited in its application to the details of construction and to the arrangements of the components set forth in the following description or illustrated in the drawings. The invention is capable of other embodiments and of being practiced and carried out in various ways. Also, it is to be understood that the phraseology and terminology employed herein are for the purpose of description and should not be regarded as limiting.

As such, those skilled in the art will appreciate that the conception, upon which this disclosure is based, may readily be utilized as a basis for the designing of other structures, methods and systems for carrying out the several purposes of the present invention. It is important, therefore, that the claims be regarded as including such equivalent constructions insofar as they do not depart from the spirit and scope of the present invention.

Further, the purpose of the foregoing abstract is to enable the U.S. Patent and Trademark Office and the public generally, and especially the scientists, engineers and practitioners in the art who are not familiar with patent or legal terms or phraseology, to determine quickly from a cursory inspection the nature and essence of the technical disclosure of the application. The abstract is neither intended to define the invention of the application, which is measured by the claims, nor is it intended to be limiting as to the scope of the invention in any way.

It is therefore an object of the present invention to provide a new earphone apparatus and method which has many of the advantages of the sound producing earplugs mentioned heretofore and many novel features that result in a new earphone which is not anticipated, rendered obvious, suggested, or even implied by any of the prior art sound producing earplugs, either alone or in any combination thereof.

It is another object of the present invention to provide a new earphone which may be easily and efficiently manufactured and marketed.

It is a further object of the present invention to provide a new earphone which is of a durable and reliable construction.

An even further object of the present invention is to provide a new earphone which is susceptible of a low cost of manufacture with regard to both materials and labor, and which accordingly is then susceptible of low prices of sale to the consuming public, thereby making such earphone economically available to the buying public.

Still yet another object of the present invention is to provide a new earphone which provides in the apparatuses and methods of the prior art some of the advantages thereof, while simultaneously overcoming some of the disadvantages normally associated therewith.

Still another object of the present invention is to provide a new earphone for comfortably fitting into the ear to listen to a personal stereo.

Yet another object of the present invention is to provide a new earphone which includes a housing adapted for inserting in to an ear of a person. A speaker is adapted for reproducing sound generated by a personal stereo. The speaker is operationally coupled to the personal stereo. The speaker is mounted within the housing. A plurality of bores through the housing are adapted for equalizing air pressure between the atmosphere and the ear of the user.

Still yet another object of the present invention is to provide a new earphone that provides suffers of Tinnitus with a means to comfortably and securely wear the earphone while sleeping so that audio treatment is not interrupted.

Even still another object of the present invention is to provide a new earphone that is comfortable and secure to use while one listens to music during everyday activities or sleeping.

These together with other objects of the invention, along with the various features of novelty which characterize the invention, are pointed out with particularity in the claims annexed to and forming a part of this disclosure. For a better understanding of the invention, its operating advantages and the specific objects attained by its uses, reference should be made to the accompanying drawings and descriptive matter in which there are illustrated preferred embodiments of the invention.

BRIEF DESCRIPTION OF THE DRAWINGS

The invention will be better understood and objects other than those set forth above will become apparent when consideration is given to the following detailed description thereof. Such description makes reference to the annexed drawings wherein.

DESCRIPTION OF THE PREFERRED EMBODIMENT

Figure 1:
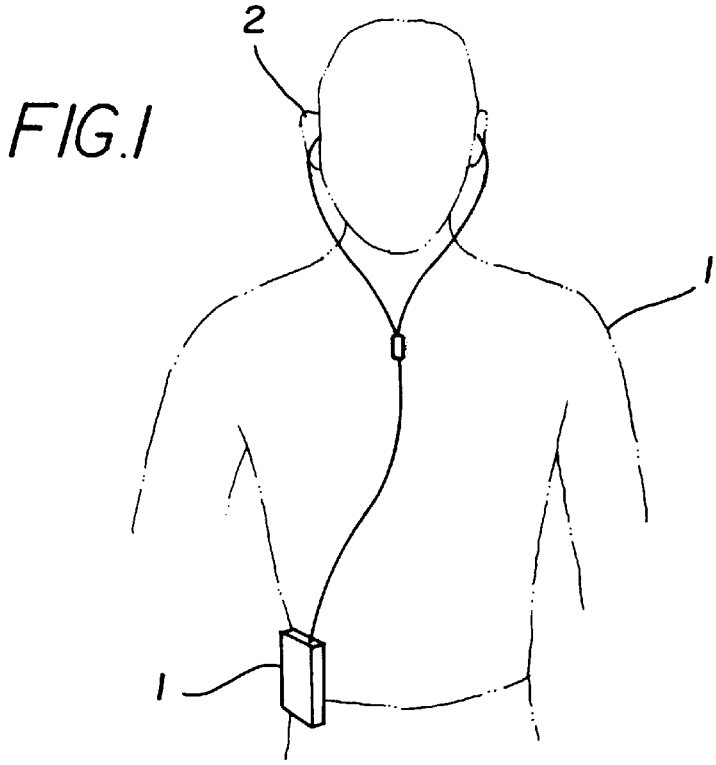
FIG. 1 is an in use view of a new earphone according to the present invention.
Figure 2:
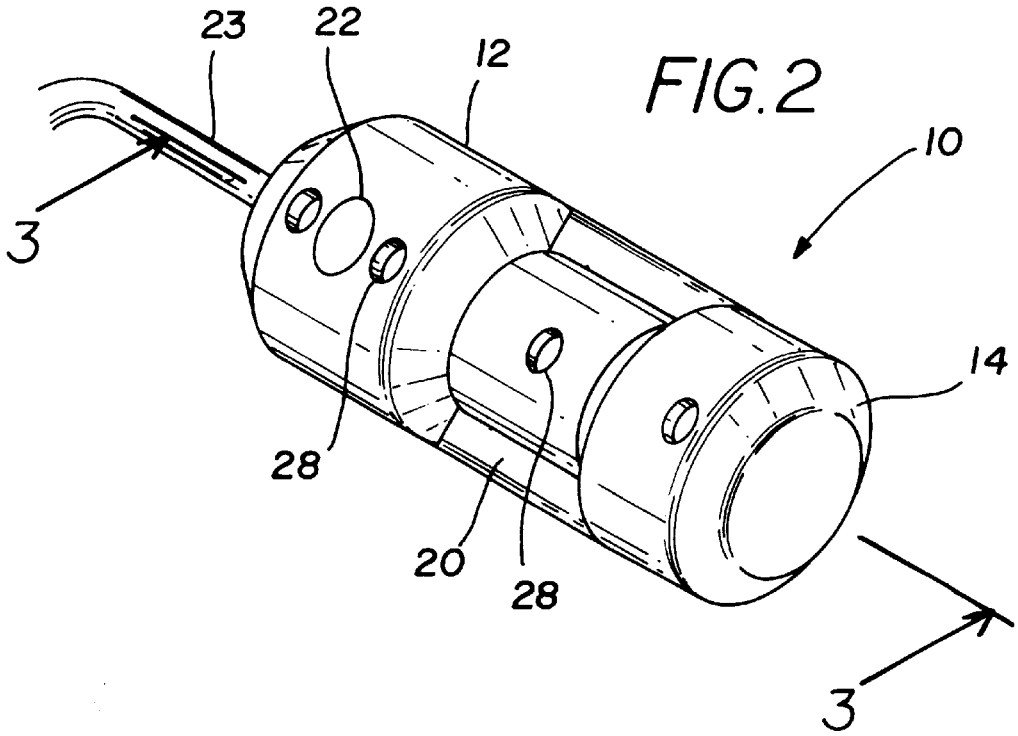
FIG. 2 is an enlarged front perspective view of the present invention.

With reference now to the drawings, and in particular to FIGS. 1 through 6 thereof, a new earphone embodying the principles and concepts of the present invention and generally designated by the reference numeral 10 will be described.

As best illustrated in FIGS. 1 through 6, the earphone 10 generally comprises a generally cylindrical housing 12 is adapted for inserting in to an ear 2 of a person 1. The housing has a pair end sections 14 with a beveled edge for ease of insertion of the housing into the ear. The housing has an inner core 16 and an outer covering 18. The inner core consists of an elastic flexible material such as a foam rubber. The outer cover encases the inner core. The outer cover consisting of an inelastic flexible material such as a soft plastic. The inner core and outer covering allows for the housing to conform to the shape of the acoustic meatus of the ear after the insertion of the housing into the ear. The flexibility of the housing provides greater comfort while a person sleeps.

An arcuate cutout 20 in said housing for aiding in the retention of the housing in the ear. The arcuate cutout allows the housing to settle around the tragus of the ear. The arcuate cutout extends along a length of the housing with the arcuate cutout extending across about half of the circumference of the housing. The cutout extends along about half of the length of the housing.

Figure 3:
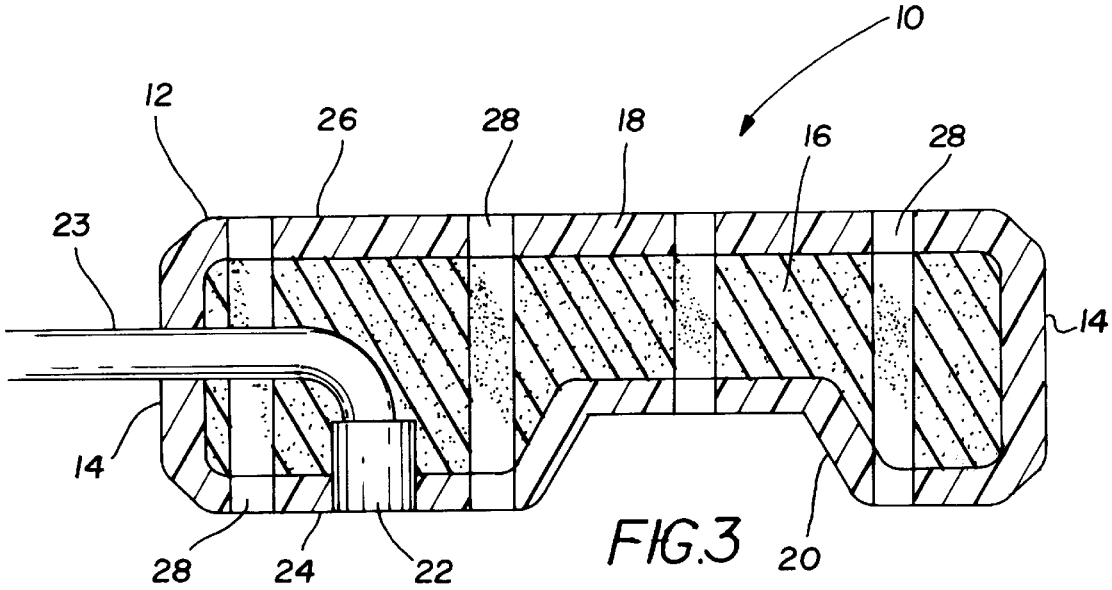
FIG. 3 is a cross-sectional view of the present invention along line 3—3 of FIG. 2.
Figure 4:
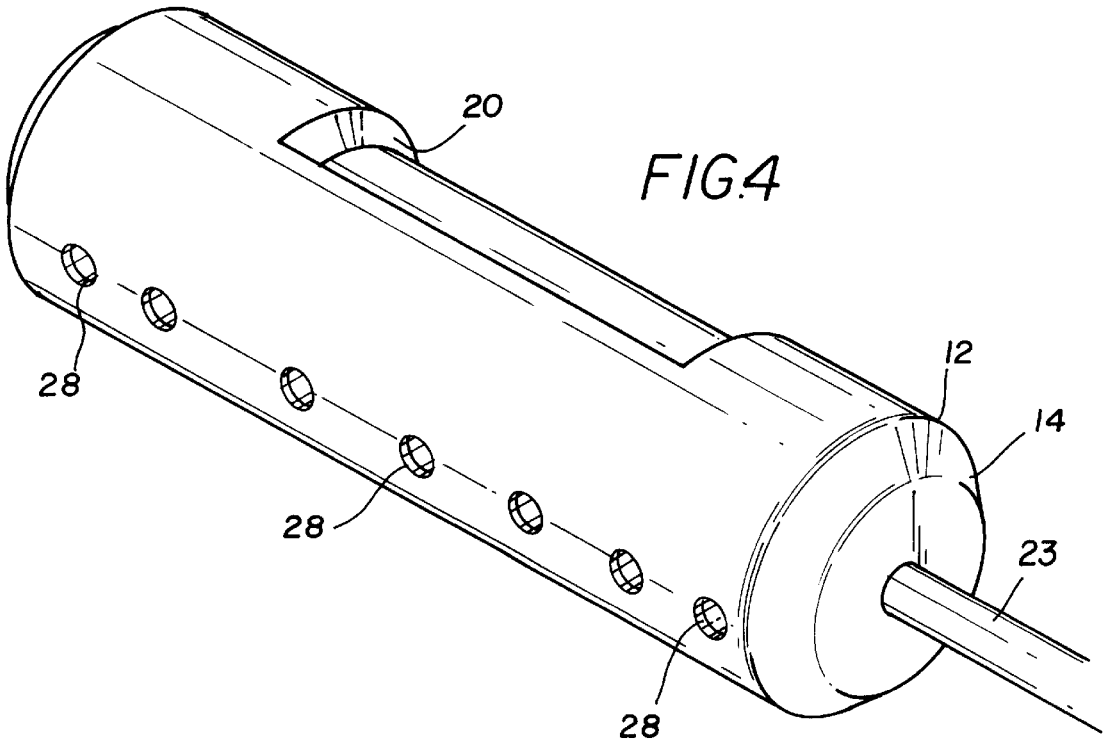
FIG. 4 is a rear perspective view of the present invention.

As shown in FIG. 3, a speaker 22 is adapted for reproducing sound from electrical signals generated by a personal stereo 3. The speaker is operationally coupled to the personal stereo by a chord 23 comprising a pair of wires. The speaker is mounted in the housing such that the speaker is positioned proximate an outer surface 24 of a sidewall 26 of the housing. The speaker is positioned between the cutout and one of the end sections. The chord extends through the end section proximate the speaker.

Also shown in FIG. 3, a plurality of bores 28 extending through the housing are adapted for equalizing air pressure between the atmosphere and the ear of the user. The bores extend through a center of the housing and are aligned perpendicularly to a longitudinal axis of the housing.

Figure 5:
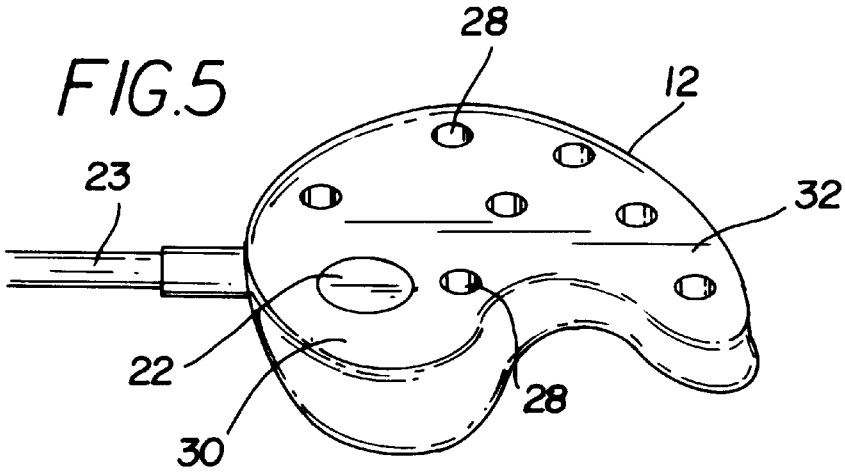
FIG. 5 is a front perspective view of an embodiment of the present invention.
Figure 6:
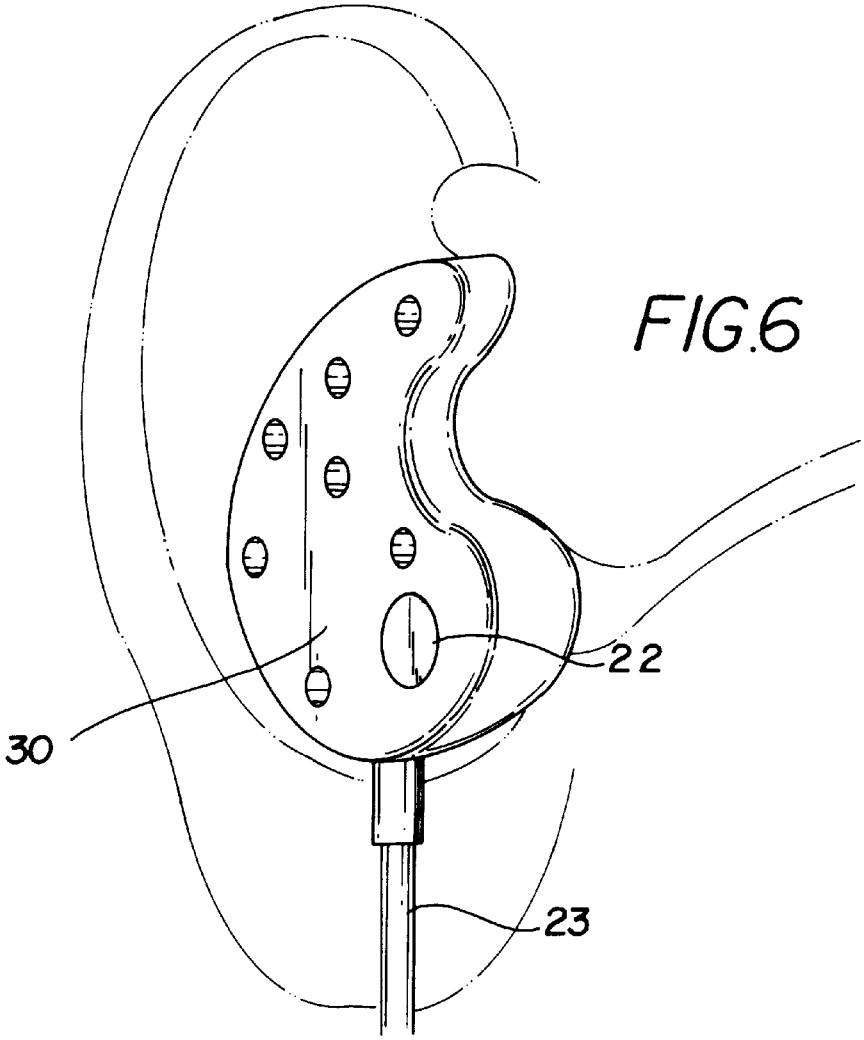
FIG. 6 is front elevational view of an embodiment of the present invention in use.

In an embodiment, as shown in FIGS. 5 and 6, the housing has a head portion 30 and a tail portion 32. The tail portion of the housing is adapted for inserting between a crus of helix of the ear and a triangular fossa of the ear such that the head portion is located proximate the acoustic meatus of the ear. The speaker is located within the head portion of the housing and the bores extend through the width of the housing. The speaker is positioned proximate an outer surface of a sidewall of the housing such that the speaker is positioned directly below the tail portion of the housing. The chord extends through the bottom of the head portion of the housing.

In use, the user would take the ear phone and connect the earphone to the head phones jack of a personal stereo. The earphone is then placed within the ear so that the earphone is comfortably but securely in place. The volume is adjusted so that it is at a comfortable level. The user would then be free to pursue every day tasks as well as sleeping without the earphones becoming dislodged or being uncomfortable. The bores through the housing prevent a pressure difference from being formed between the outside atmosphere and the middle ear thus preventing As to a further discussion of the manner of usage and operation of the present invention, the same should be apparent from the above description. Accordingly, no further discussion relating to the manner of usage and operation will be provided.

With respect to the above description then, it is to be realized that the optimum dimensional relationships for the parts of the invention, to include variations in size, materials, shape, form, function and manner of operation, assembly and use, are deemed readily apparent and obvious to one skilled in the art, and all equivalent relationships to those illustrated in the drawings and described in the specification are intended to be encompassed by the present invention.

Therefore, the foregoing is considered as illustrative only of the principles of the invention. Further, since numerous modifications and changes will readily occur to those skilled in the art, it is not desired to limit the invention to the exact construction and operation shown and described, and accordingly, all suitable modifications and equivalents may be resorted to, falling within the scope of the invention.

I claim:

1. An earphone for inserting in a ear of a person to reproduce sounds generated by a personal stereo, the earphone comprising:

a housing being adapted for inserting in to the ear of the person;

a speaker being adapted for reproducing sound generated by the personal stereo, said speaker being operationally coupled to the personal stereo, said speaker being mounted within said housing;

a plurality of bores through said housing being adapted for equalizing air pressure between the atmosphere and the ear of the person;

said housing having an inner core, said inner core consists of an elastic flexible material; and said housing having an outer cover is for encasing said inner core, said outer cover consists of an inelastic flexible material.

2. The earphone as set forth in claim 1 wherein said housing has a cylindrical shape.

3. The earphone as set forth in claim 2 wherein said bores extend through the center of said housing and are aligned perpendicularly to a longitudinal axis of said housing.

4. The earphone as set forth in claim 2 wherein said housing has a pair end sections with a beveled edge for easing the insertion of said housing into the ear.

5. The earphone as set forth in claim 2 wherein said housing further comprises an arcuate cutout for aiding in the retention of said housing in the ear, said arcuate cutout extending along a length of said housing.

6. The earphone as set forth in claim 5 wherein said arcuate cutout extending across about half of the circumference of said housing, said cutout extending along about half of the length of said housing.

7. The earphone as set forth in claim 1 wherein said speaker is positioned proximate an outer surface of a sidewall of said housing.

8. The earphone as set forth in claim 1 wherein said housing has a head portion and a tail portion, said tail portion is adapted for inserting between a crus of helix of the ear and a triangular fossa of the ear such that said head portion is located proximate an acoustic meatus of the ear.

9. The earphone as set forth in claim 8 wherein said speaker is located within said head portion of said housing.

10. The earphone as set forth in claim 9 wherein said speaker is operationally coupled to the personal stereo by a chord comprising a pair of wires, said speaker is positioned proximate an outer surface of a sidewall of said housing such that said speaker is positioned directly below said tail portion of said housing, said chord extends through the bottom of said head portion of said housing.

11. An earphone for inserting in a ear of a person to reproduce sounds generated by a personal stereo, the earphone comprising:

a generally cylindrical housing being adapted for inserting in to the ear of the person, said housing has a pair of end sections with a beveled edge for easing the insertion of said housing into the ear, said housing having an inner core and an outer covering, said inner core consisting of an elastic flexible material, said outer cover encasing said inner core, said outer cover consisting of an inelastic flexible material;

an arcuate cutout in said housing for aiding in the retention of said housing in the ear, said arcuate cutout extending along a portion of a length of said housing, said arcuate cutout extending across about half of the circumference of said housing, said cutout extending along about half of the length of said housing;

a speaker being adapted for reproducing sound from electrical signals generated by the personal stereo, said speaker being operationally coupled to the personal stereo by a chord comprising a pair of wires, said speaker being mounted in said housing, said speaker being positioned proximate an outer surface of a sidewall of said housing such that said speaker is positioned between said cutout and one of said end sections, said chord extending through said end section proximate said speaker; and a plurality of bores extending through said housing for equalizing air pressure between the atmosphere and the air inside the ear of the user, said bores extending through a center of said housing and being aligned perpendicularly to a longitudinal axis of said housing.

12. An earphone for inserting in a ear of a person to reproduce sounds generated by a personal stereo, the earphone comprising:

a housing being adapted for inserting in to the ear of the person;

a speaker being adapted for reproducing sound generated by the personal stereo, said speaker being operationally coupled to the personal stereo, said speaker being mounted within said housing;

a plurality of bores through said housing being adapted for equalizing air pressure between the atmosphere and the ear of the person;

said housing having a cylindrical shape; and said bores extending through the center of said housing and are aligned perpendicularly to a longitudinal axis of said housing.

13. The earphone as set forth in claim 12 wherein said housing has a pair end sections with a beveled edge for easing the insertion of said housing into the ear.

14. The earphone as set forth in claim 12 wherein said housing further comprises an arcuate cutout for aiding in the retention of said housing in the ear, said arcuate cutout extending along a length of said housing.

15. The earphone as set forth in claim 14 wherein said arcuate cutout extending across about half of the circumference of said housing, said cutout extending along about half of the length of said housing.

16. The earphone as set forth in claim 12 wherein said speaker is positioned proximate an outer surface of a sidewall of said housing.

17. The earphone as set forth in claim 12 wherein said housing has a head portion and a tail portion, said tail portion is adapted for inserting between a crus of helix of the ear and a triangular fossa of the ear such that said head portion is located proximate an acoustic meatus of the ear.

18. The earphone as set forth in claim 17 wherein said speaker is located within said head portion of said housing.

19. The earphone as set forth in claim 18 wherein said speaker is operationally coupled to the personal stereo by a chord comprising a pair of wires, said speaker is positioned proximate an outer surface of a sidewall of said housing such that said speaker is positioned directly below said tail portion of said housing, said chord extends through the bottom of said head portion of said housing.

* * * * *